US007240509B2

(12) United States Patent
Han et al.

(10) Patent No.: US 7,240,509 B2
(45) Date of Patent: Jul. 10, 2007

(54) HEATING AND COOLING SYSTEM

(75) Inventors: Heien Sou Han, Taoyuan Hsien (TW); Way Jone Hsiao, Taoyuan Hsien (TW); Che Fu Liu, Taoyuan Hsien (TW)

(73) Assignee: Kaori Heat Treatment Co., Ltd., Neidinli Gongyeh Chu Chongli, Taoyuan Hsien (TW)

( * ) Notice: Subject to any disclaimer, the term of this patent is extended or adjusted under 35 U.S.C. 154(b) by 122 days.

(21) Appl. No.: 11/226,946

(22) Filed: Sep. 14, 2005

(65) Prior Publication Data

US 2007/0056310 A1 Mar. 15, 2007

(51) Int. Cl.
*F25B 13/00* (2006.01)

(52) U.S. Cl. ..... 62/324.1

(58) Field of Classification Search ..... 62/160, 62/324.1, 183, 238.7, 324.6; 237/2 B
See application file for complete search history.

(56) References Cited

U.S. PATENT DOCUMENTS 3,188,829 A * 6/1965 Siewert et al. ..... 62/160
3,308,877 A * 3/1967 Gerteis ..... 165/240
3,366,166 A * 1/1968 Gerteis ..... 165/240
3,916,638 A * 11/1975 Schmidt ..... 62/238.1
4,055,963 A * 11/1977 Shoji et al. ..... 62/238.6
4,148,436 A * 4/1979 Shaw ..... 237/2 B
4,893,476 A * 1/1990 Bos et al. ..... 62/79
4,938,032 A * 7/1990 Mudford ..... 62/160
5,099,651 A * 3/1992 Fischer ..... 62/79
5,239,838 A 8/1993 Tressler ..... 62/324.1
5,678,626 A * 10/1997 Gilles ..... 165/62
5,906,104 A * 5/1999 Schwartz et al. ..... 62/79
5,937,665 A * 8/1999 Kiessel et al. ..... 62/260
5,983,660 A * 11/1999 Kiessel et al. ..... 62/324.5

FOREIGN PATENT DOCUMENTS

GB 2241565 A * 9/1991

* cited by examiner

*Primary Examiner*—Mohammad M. Ali
(74) *Attorney, Agent, or Firm*—Charles E. Baxley

(57) ABSTRACT

A heating and cooling system includes a compressor for pumping a heat medium through a tubing device, a heat exchanger coupled to the compressor for receiving compressed heat medium from the compressor, a flowing control device coupled to the heat exchanger, another heat exchanger coupled to the flowing control device and arranged to have the flowing control device coupled between the heat exchangers, and an air conditioner coupled to the flowing control device. The flowing control device may selectively couple the heat exchangers to the air conditioner and to the compressor, or selectively couple the heat exchangers together and to selectively couple the air conditioner to the compressor.

7 Claims, 4 Drawing Sheets

HEATING AND COOLING SYSTEM

BACKGROUND OF THE INVENTION

1. Field of the Invention

The present invention relates to a heating and cooling system, and more particularly to a heating and cooling system having a changeable or control device for changing the flowing of the medium, to generate heat for winter times, and to generate cold air or the like for summer times.

2. Description of the Prior Art

Typical air conditioning facilities comprise a compressor for pumping air or heat medium through an air flowing manifold, and one or more heat exchangers and one or more valves also disposed or coupled in the air flowing manifold, for generating cooling air and for air conditioning purposes. However, normally, the typical air conditioning facilities may be used for generating cooling air only, and are thus suitable for being used in summer times only, but may not be used in winter times.

The typical heaters or other heating facilities are required to be energized by electric energy, and are provided for generating heat energy to warm the house buildings. However, the typical heaters or other heating facilities are suitable for being used in winter times only, but may not be used in summer times.

The other typical air conditioning facilities may comprise a heating and cooling system for generating either hot air or cold air for different uses. For example, U.S. Pat. No. 5,239,838 to Tressler comprises a typical refrigeration circuit for air conditioning purposes, and further comprises a hot water system for generating heated water.

However, the additional hot water system is further required to be provided and includes a pump and a solar panel or a water heater for heating the water, such that additional piping systems are required to be provided and assembled and coupled to the typical refrigeration circuit, and such that the assembling procedures for the typical heating and cooling systems may be complicated, and such that the manufacturing cost for the typical heating and cooling systems may be greatly increased.

The present invention has arisen to mitigate and/or obviate the afore-described disadvantages of the conventional heating and cooling systems.

SUMMARY OF THE INVENTION

The primary objective of the present invention is to provide a heating and cooling system including a changeable or control device for changing the flowing of the medium, to generate heat for winter times, and to generate cold air or the like for air conditioning purposes during summer times.

In accordance with one aspect of the invention, there is provided a heating and cooling system comprising a compressor for pumping a heat medium through a tubing device, a first heat exchanger coupled to the compressor, for receiving compressed heat medium from the compressor, a flowing control device coupled to the first heat exchanger, a second heat exchanger coupled to the flowing control device, and arranged to have the flowing control device coupled between the first heat exchanger and the second heat exchanger, and an air conditioner coupled to the flowing control device, the flowing control device being provided to selectively couple the first heat exchanger to the air conditioner and to couple the second heat exchanger to the compressor, or to selectively couple the first heat exchanger to the second heat exchanger and to selectively couple the air conditioner to the compressor.

The first heat exchanger is provided for generating an output heat medium when the flowing control device selectively couples the first heat exchanger to the air conditioner and couples the second heat exchanger to the compressor.

The air conditioner is provided for generating an output heat medium when the flowing control device selectively couples the first heat exchanger to the air conditioner and couples the second heat exchanger to the compressor.

The air conditioner is provided for generating an output cold medium when the flowing control device selectively couples the first heat exchanger to the second heat exchanger and to couples the air conditioner to the compressor.

A throttle control device may further be provided and coupled between the second heat exchanger and the air conditioner. An accumulating device may further be provided and coupled between the first heat exchanger and the compressor. A pressure control device may further be provided and coupled between an output port of the accumulating device and an input port of the compressor.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
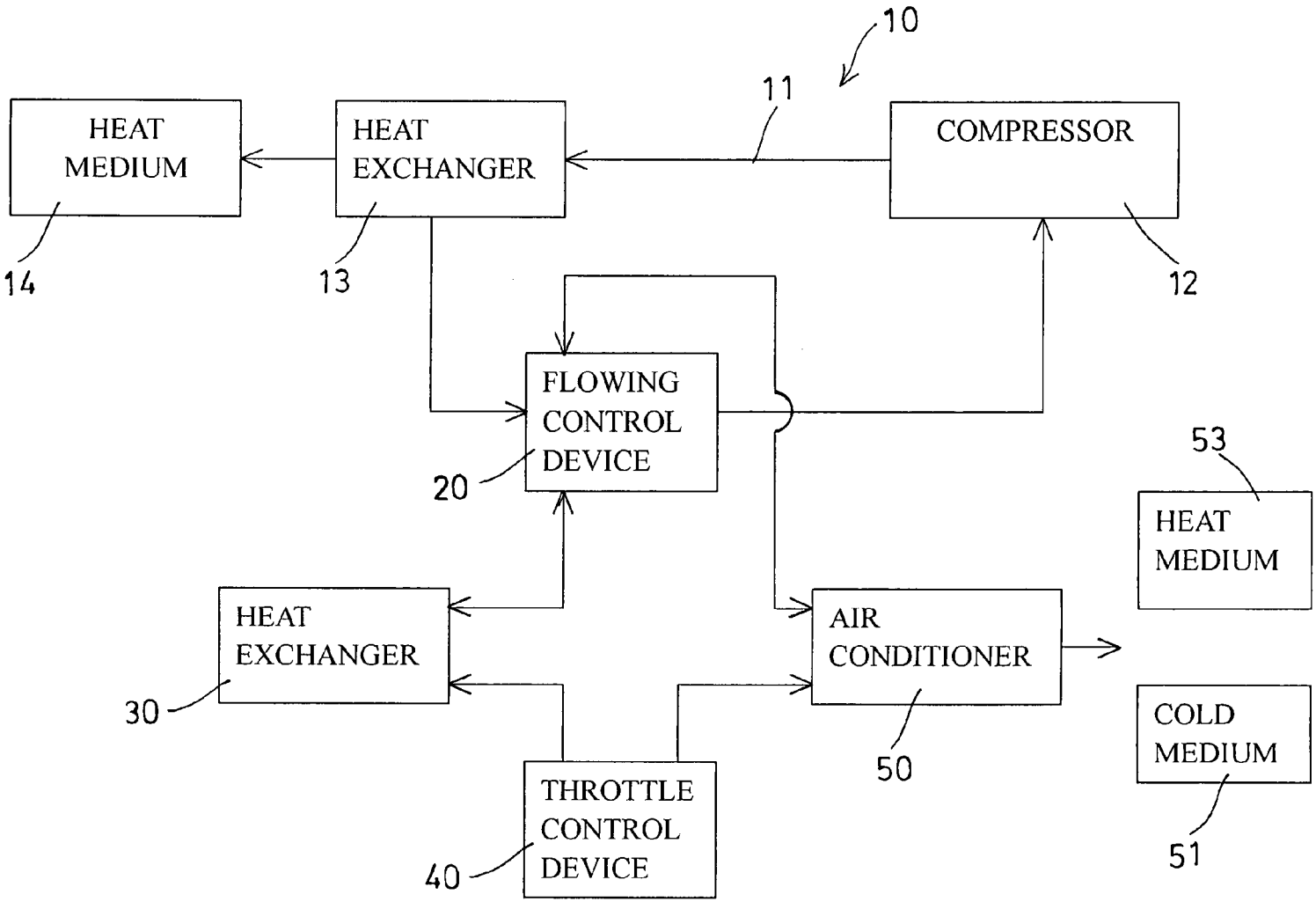
FIG. 1 is a block diagram of a heating and cooling system in accordance with the present invention.
Figure 2:
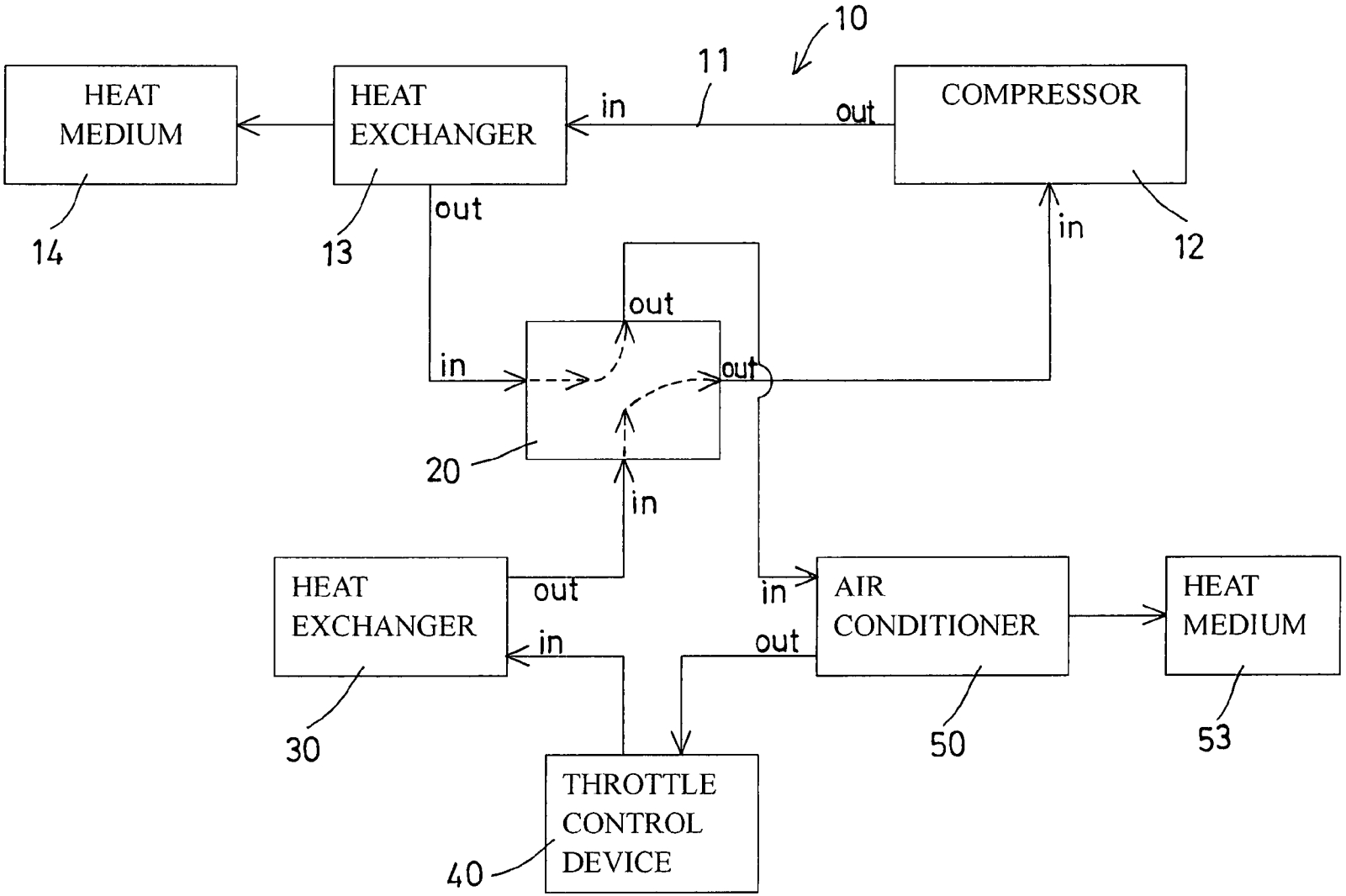
FIG. 2 is a block diagram similar to FIG. 1, illustrating the operation of the heating and cooling system.

Referring to the drawings, and initially to FIGS. 1 and 2, a heating and cooling system 10 in accordance with the present invention may comprise a flowing or tubing device 11 having a heat medium flowing through the tubing device 11, and may also comprise a compressor 12 for pumping the heat medium through the tubing device 11.

The heating and cooling system 10 further includes a primary or a first heat exchanging device or a heat exchanger 13 coupled to the compressor 12, for receiving the compressed medium from the compressor 12. The first heat exchanger 13 may be used for outputting heat, or for generating an output heat medium 14, such as hot water, hot air, or the like.

A flowing control device 20 is coupled to the first heat exchanger 13, and then coupled to a second heat exchanger 30, and arranged to have the flowing control device 20 coupled between the first heat exchanger 13 and the second heat exchanger 30. The flowing control device 20 is also coupled between the second heat exchanger 30 and the compressor 12.

The second heat exchanger 30 is then coupled to another control device or a throttle control device 40, such as a capillary tube or an expansion valve, or the like, which is then coupled to another heat exchanger or an air conditioner 50, in which the flowing control device 20 is arranged to be coupled between the air conditioner 50 and the compressor 12.

For example, the another heat exchanger or the air conditioner 50 may be used either for outputting cold, such as for generating an output cold medium 51 (FIGS. 1, 3), such as cold water, cold air, or the like, or for outputting heat, such as for generating a further output heat medium 53 (FIGS. 1, 2), such as hot water, hot air, or the like.

Figure 3:
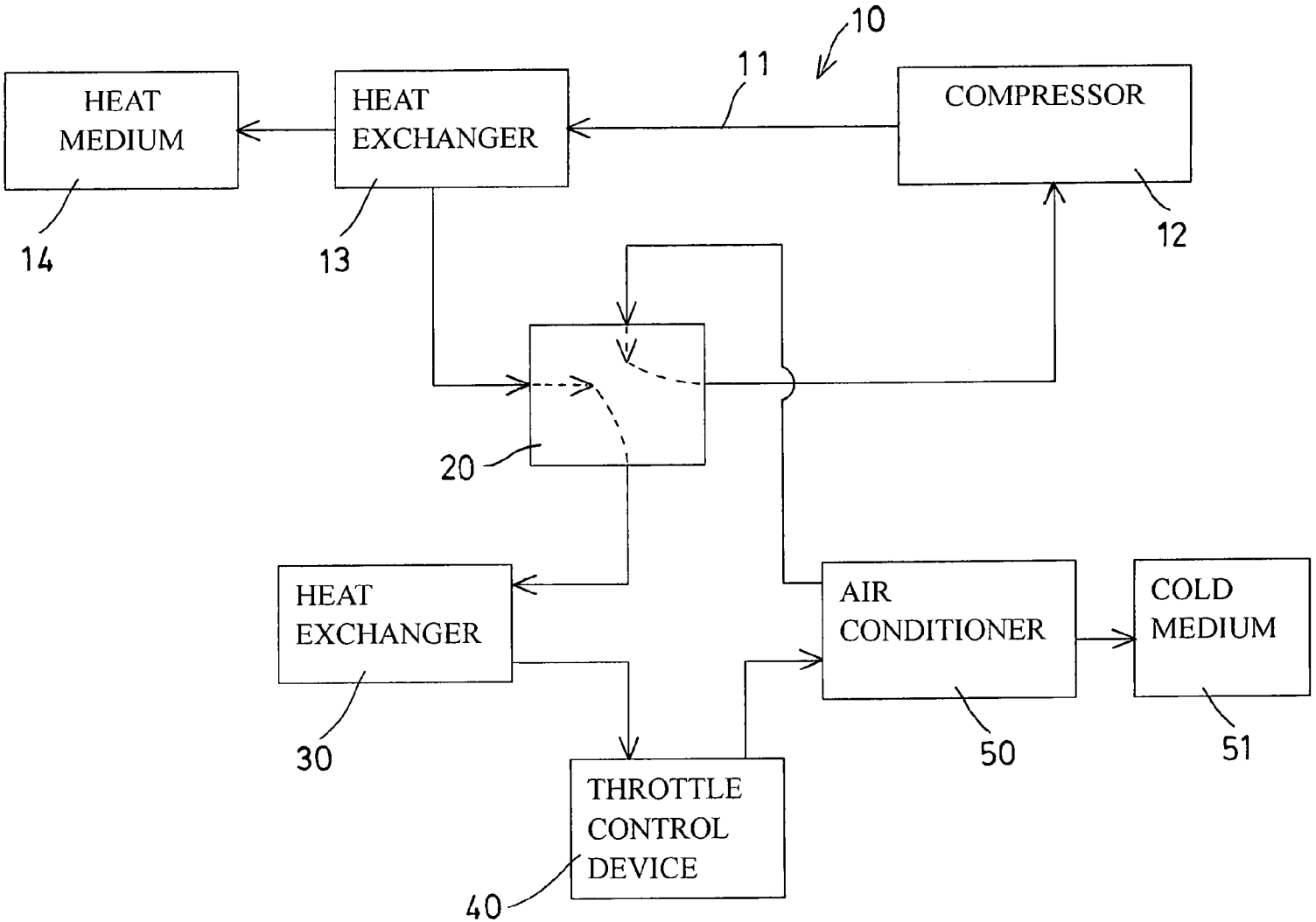
FIG. 3 is a block diagrams similar to FIG. 2, illustrating the other operation of the heating and cooling system.

The flowing control device 20 is arranged for selectively coupling the first heat exchanger 13 to the air conditioner 50, and for selectively coupling the second heat exchanger 30 to the compressor 12, as shown in FIG. 2; or as shown in FIG. 3, for selectively coupling the first heat exchanger 13 to the second heat exchanger 30, and for selectively coupling the air conditioner 50 to the compressor 12.

In operation, as shown in FIG. 2, during the winter times, the heat medium from the compressor 12 may flow through the first heat exchanger 13, to generate the heat medium 14, such as hot water, hot air, or the like. The flowing control device 20 may also control the heat medium to flow from the first heat exchanger 13, through the flowing control device 20, and then to flow into the air conditioner 50, in order to generate the other heat medium 53, such as hot water, hot air, or the like.

The heat medium may then flow through the throttle control device 40 and the second heat exchanger 30, and then to flow back to the compressor 12 via the flowing control device 20, in order to form an enclosed or an endless flowing cycle. Accordingly, during the winter times, one or more heat media 14, 53 such as hot water, hot air, or the like may be generated and provided for the users.

On the contrary, as shown in FIG. 3, during the summer times, the heat medium from the compressor 12 may also flow through the first heat exchanger 13, to generate the heat medium 14, such as hot water, hot air, or the like. The flowing control device 20 may then selectively control the heat medium to flow from the first heat exchanger 13 through the second heat exchanger 30, and then to flow into the air conditioner 50 via the throttle control device 40, in order to generate and output the cold medium 51, such as cold water, cold air, or the like, and for such as air conditioning purposes.

The air conditioner 50 may then be coupled to the compressor 12 by or via the flowing control device 20, to allow the heat medium to flow back to the compressor 12 via the flowing control device 20, in order to form another or a different enclosed or an endless flowing cycle.

It is to be noted that the typical air conditioning facilities or the typical heating and cooling systems failed to provide a flowing control device 20 to selectively couple the first heat exchanger 13 to the air conditioner 50, and to selectively couple the second heat exchanger 30 to the compressor 12; or to selectively couple the first heat exchanger 13 to the second heat exchanger 30, and to selectively couple the air-conditioner 50 to the compressor 12.

Figure 4:
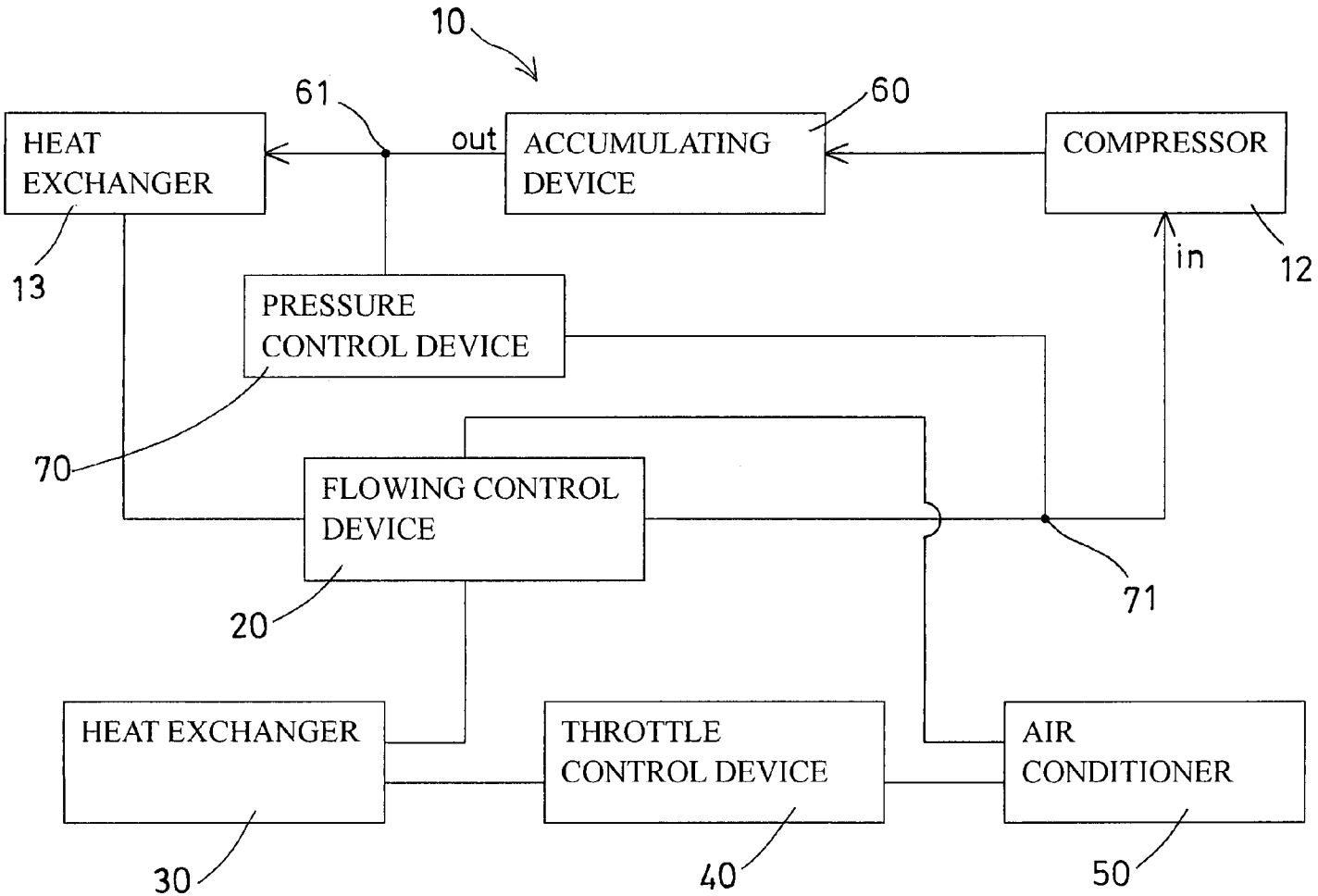
FIG. 4 is a block diagram similar to FIGS. 1–3, illustrating the other arrangement of the control devices for the heating and cooling system.

Selectively, as shown in FIG. 4, an accumulator or accumulating device 60 may further be provided and coupled between the compressor 12 and the first heat exchanger 13, for accumulating or collecting the heat medium, and then for supplying pressurized heat medium to the first heat exchanger 13. A pressure control device 70 may further be provided and coupled between an output terminal or port 61 of the accumulating device 60 and the input terminal or port 71 of the compressor 12, in order to control or to balance the pressure in or between the output terminal or port 61 of the accumulating device 60 and the input terminal or port 71 of the compressor 12.

Accordingly, the heating and cooling system in accordance with the present invention includes a changeable or control device for changing the flowing of the heat medium, to generate heat for warming the house building during the winter times, or to generate cold air or the like for air conditioning purposes during the summer times.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A heating and cooling system comprising:

a compressor for pumping a heat medium through a tubing device, a first heat exchanger coupled to said compressor, for receiving compressed heat medium from said compressor, a flowing control device coupled to said first heat exchanger, a second heat exchanger coupled to said flowing control device, and arranged to have said flowing control device coupled between said first heat exchanger and said second heat exchanger, and an air conditioner coupled to said flowing control device, said flowing control device being provided to selectively couple said first heat exchanger to said air conditioner and to couple said second heat exchanger to said compressor, or to selectively couple said first heat exchanger to said second heat exchanger and to selectively couple said air conditioner to said compressor.

2. The heating and cooling system as claimed in claim 1, wherein said first heat exchanger is provided for generating an output heat medium when said flowing control device selectively couples said first heat exchanger to said air conditioner and couples said second heat exchanger to said compressor.

3. The heating and cooling system as claimed in claim 1, wherein said air conditioner is provided for generating an output heat medium when said flowing control device selectively couples said first heat exchanger to said air conditioner and couples said second heat exchanger to said compressor.

4. The heating and cooling system as claimed in claim 1, wherein said air conditioner is provided for generating an output cold medium when said flowing control device selectively couples said first heat exchanger to said second heat exchanger and to couples said air conditioner to said compressor.

5. The heating and cooling system as claimed in claim 1 further comprising a throttle control device coupled between said second heat exchanger and said air conditioner.

6. The heating and cooling system as claimed in claim 1 further comprising an accumulating device coupled between said first heat exchanger and said compressor.

7. The heating and cooling system as claimed in claim 6 further comprising a pressure control device coupled between an output port of said accumulating device and an input port of said compressor.

* * * * *